United States Patent [19]

Reist

[11] Patent Number: 4,566,686

[45] Date of Patent: Jan. 28, 1986

[54] APPARATUS FOR FORMING A SPIRAL-LAYERED COILED STACK FROM SUBSTANTIALLY TWO-DIMENSIONAL FLAT STRUCTURES CONTINUOUSLY ARRIVING IN IMBRICATED FORMATION

[75] Inventor: Walter Reist, Hinwil, Switzerland

[73] Assignee: Ferag AG, Hinwil, Switzerland

[21] Appl. No.: 719,721

[22] Filed: Apr. 3, 1985

[30] Foreign Application Priority Data

Apr. 19, 1984 [CH] Switzerland ..... 1984/84
Sep. 21, 1984 [CH] Switzerland ..... 4533/84

[51] Int. Cl.[4] ..... B65H 29/50

[52] U.S. Cl. ..... 271/201; 271/186; 271/215; 271/216

[58] Field of Search ..... 271/3.1, 207, 213, 215, 271/216, 217, 186, 200, 201

[56] References Cited

U.S. PATENT DOCUMENTS 2,683,601 7/1954 Camerano ..... 271/216
4,062,537 12/1977 Dietrich ..... 271/201
4,230,311 10/1980 Faltin ..... 271/216 X
4,274,623 6/1981 Reist ..... 271/213 X

*Primary Examiner*—Richard A. Schacher
*Attorney, Agent, or Firm*—Werner W. Kleeman

[57] ABSTRACT

A stack support rotating about an upright axis is arranged beneath a discharge station of a delivery conveyor for the imbricated formation. The stack support and at least the discharge station of the delivery conveyor are adjustable in height in relation to one another. In order to increase the storage capacity of the spiral-layered coiled stack being formed, respectively in order to reduce its height for the same content, a drive mechanism is provided to periodically displace the discharge station of the delivery conveyor and the axis of rotation of the stack support relative to one another periodically and alternatingly toward and away from one another. A spiral-layered coiled stack thus forms in which each layer of the coil consists of a flat spiral preferably comprising a plurality of spiral windings progressing from the interior to the exterior and from the exterior to the interior in alternate layers.

25 Claims, 5 Drawing Figures

Fig. 3
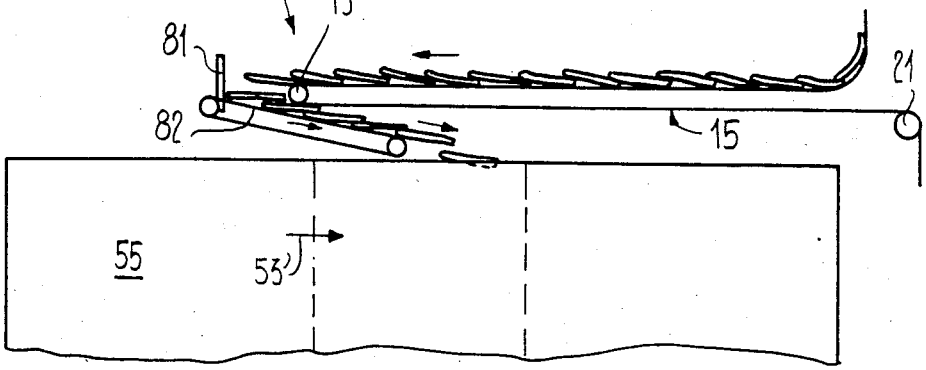
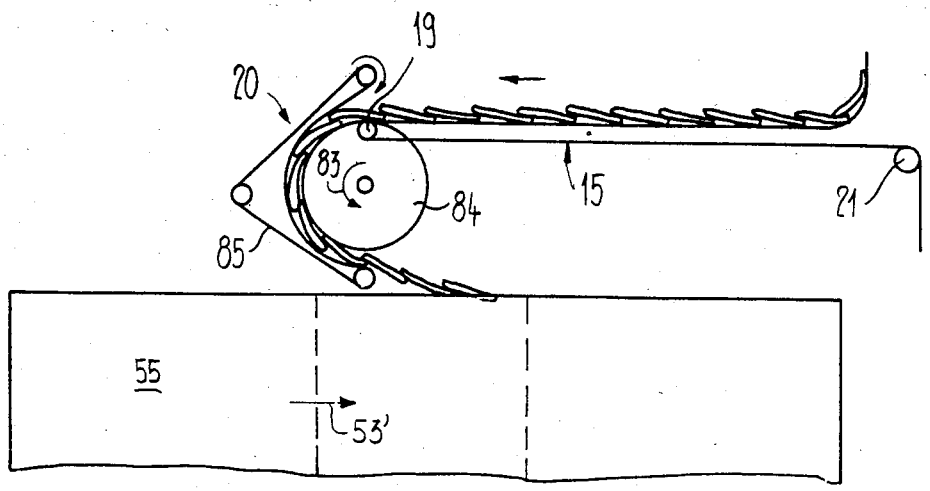
Fig. 4

APPARATUS FOR FORMING A SPIRAL-LAYERED COILED STACK FROM SUBSTANTIALLY TWO-DIMENSIONAL FLAT STRUCTURES CONTINUOUSLY ARRIVING IN IMBRICATED FORMATION

BACKGROUND OF THE INVENTION

The present invention broadly relates to storage devices and, more specifically, pertains to a new and improved construction of an apparatus for forming a spiral-layered coiled stack of printed products.

Generally speaking, the apparatus of the present invention is intended for forming a spiral-layered coiled stack from substantially two-dimensional flat structures or entities, especially printed or printing products, continuously arriving in imbricated formation and comprises a delivery conveyor for delivering the imbricated formation, a conveyor discharge station of the delivery conveyor, and a rotary driven stack support arranged beneath the conveyor discharge station and defining an upright axis of rotation. The rotary driven stack support and at least the conveyor discharge station of the delivery conveyor are adjustable in height in relation to one another.

Such an apparatus is known, for instance, from the German Patent Publication No. 2,518,374, published Dec. 11, 1975, which is substantially identical in content to the U.S. Pat. No. 4,274,623, granted June 23, 1981. With this known apparatus, stable coiled stacks can be produced from two-dimensional flat structures or entities, even when these two-dimensional flat structures arrive in rapid sequence. The storage capacity of these stacks exceeds that of conventional, substantially block-shaped stacks by a multiple factor. A further advantage of the coiled stacks resides in the fact that the imbricated formation, although deformed, persists in the stack, which permits immediately re-establish the imbricated formation when disassembling the stack.

However, stacks formed by this known apparatus become relatively very high so that their manipulation, for instance, their transport and storage within a printing plant, is difficult. Furthermore, the storage capacity of stacks formed by this known apparatus, whose height is naturally limited by operating conditions, does not yet suffice to, for instance, accommodate the major portion of one edition of partially completed products for a newspaper or a magazine.

SUMMARY OF THE INVENTION

Therefore, with the foregoing in mind, it is a primary object of the present invention to provide a new and improved construction of an apparatus for forming a spiral-layered coiled stack which does not exhibit the aforementioned drawbacks and shortcomings of the prior art constructions.

Another and more specific object of the present invention aims at providing a new and improved construction of an apparatus of the previously mentioned type which permits the formation of spiral-layered coiled stacks whose content of individual two-dimensional flat structures or entities exceeds that of stacks formed by known apparatus of the same stack height.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that it comprises means for periodically displacing the conveyor discharge station and the upright axis of rotation of the rotary driven stack support relative to one another alternatingly toward and away from one another.

By periodically altering the distance between the upright axis of rotation of the stack support and the conveyor discharge station of the delivery conveyor, a stack is formed in which each coiled layer comprises a substantially flat spiral of two-dimensional substantially flat structures or entities, preferably containing a plurality of windings which alternatingly proceed from the interior to the exterior and from the exterior to the interior in alternating layers of the stack.

The stack thus becomes greater in diameter but significantly smaller in height, while its content of individual two-dimension flat structures or entities is simultaneously increased.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIGS. 3 and 4 schematically show alternate embodiments of the conveyor discharge station of the delivery conveyor which alter the relative position of the individual two-dimensional substantially flat structures or entitles in relation to one another within the stack in comparison to the embodiments of FIGS. 1 and 1A.

DETAILED DESCRIPTION OF THE PREFERRED EMBODIMENTS

Figure 1:
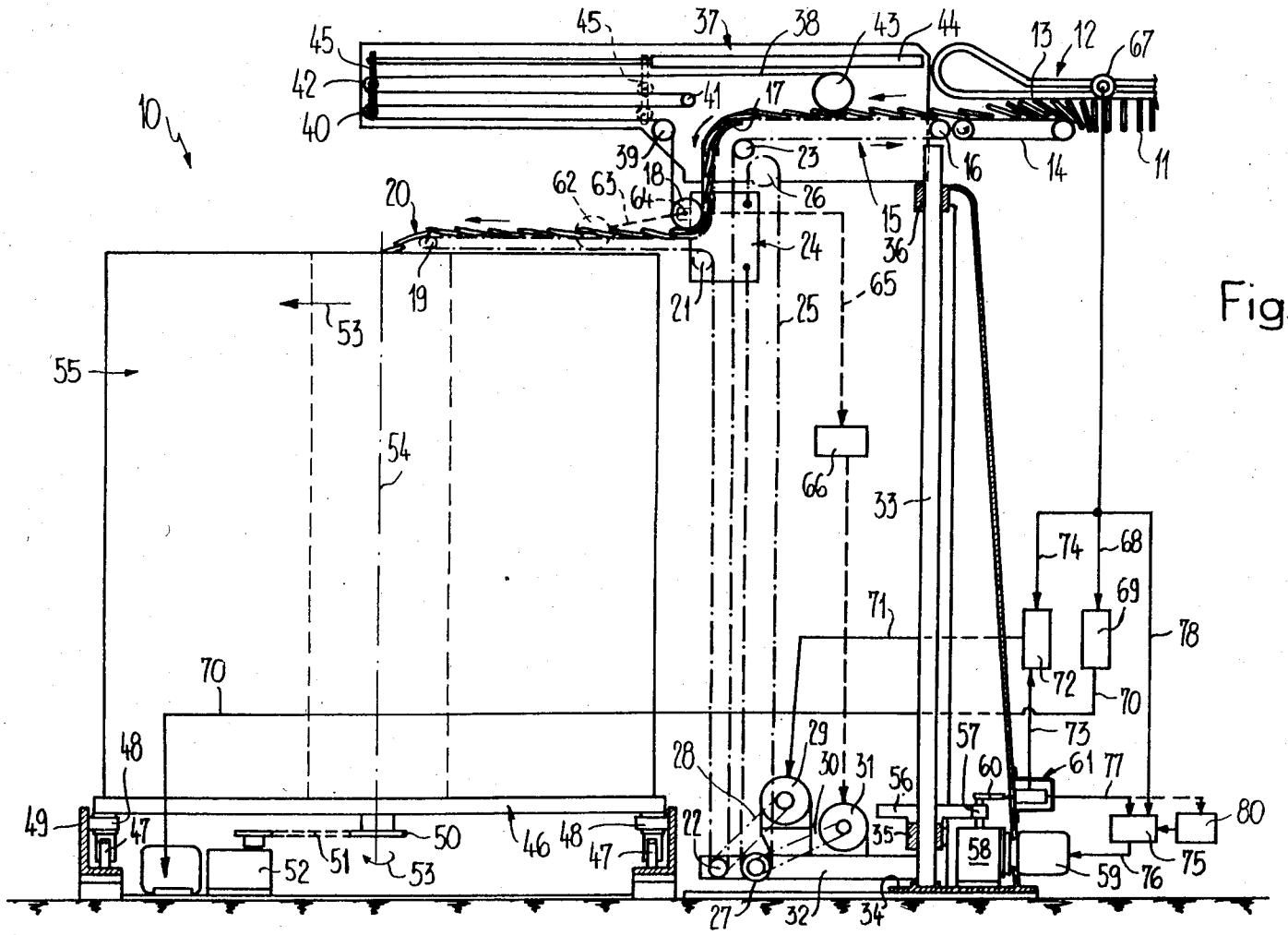
FIG. 1 schematically shows a simplified side view of an embodiment of the inventive apparatus.

Describing now the drawings, it is to be understood that to simplify the showing thereof only enough of the structure of the appartus for forming a spiral-layered coiled stack from substantially two-dimensional substantially flat structures or entities, especially printed or printing products, continuously arriving in imbricated formation has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise an apparatus 10 to which two-dimensional substantially flat structures or entities, in this illustrative embodiment newspapers 11, are delivered by means of an only schematically indicated individual or unit conveyor 12. The individual conveyor 12 may be, for instance, of the type described in the Swiss Patent No. 592,562, which is substantially identical in content to the U.S. Pat. No. 3,955,667, granted May 11, 1976, so that a more detailed description is not necessary here, especially since only the discharge end 13 of this individual conveyor 12 is illustrated in the drawings. The newspapers 11 released at the discharge end 13 are deposited on a transfer belt 14 which is driven in the same direction and with substantially the same speed as that of the individual conveyor 12. As can be seen from FIGS. 1 and 1A, an imbricated formation is formed upon the transfer belt 14 from the newspapers 11 in which the leading edge of each newspaper 11 is formed by its bound or folded edge, which overlaps the trailing edge formed by the cut or fan side of the preceding newspaper 11.

Figure 1A:
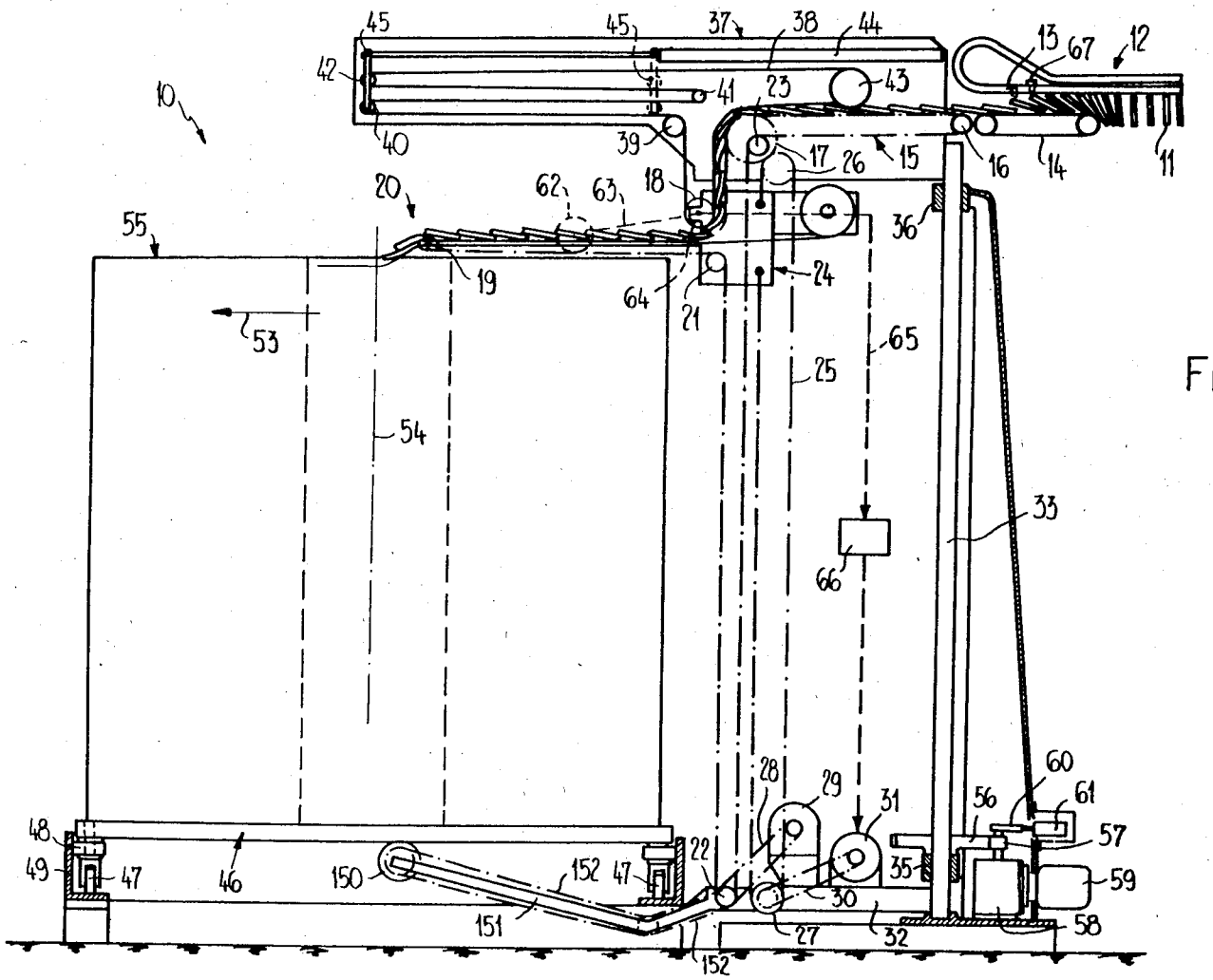
FIG. 1A schematically shows an alternate embodiment of the inventive apparatus in a representation analogous to that of FIG. 1.

The newspapers 11 arriving on the transfer belt 14 are transferred to a delivery conveyor 15 retaining their imbricated formation. The conveying or active run of the delivery conveyor 15 extends initially from a deflection roll 16 in the same direction as the transfer belt 14 and then around a deflection rail 17 vertically downward, around a further deflection roll 18 again horizontally from right to left as seen in FIGS. 1 and 1A and finally terminates at a conveyor discharge station 20 formed by a further deflection roll 19. The empty return run of the delivery conveyor 15 extends from the deflection roll 19 over a roll 21 arranged in the vicinity of the deflection roll 18 vertically downward, around a drive roll 22 and thence vertically upward again around a further deflection roll 23 and back to the deflection roll 16.

The deflection rolls 18 and the roll 21 are journaled in a frame 24. A not particularly shown cantilever arm also extends from this frame 24 and supports the deflection roll 19. Furthermore, the frame 24 is guided to be translatable in a vertical direction and therefore corresponds in this respect to the auxiliary frame designated with the reference numeral 58 described in relation to FIG. 3A of the German Patent Publication No. 2,518,374.8. The vertical guide rails for the frame 24 are not particularly shown.

Both ends of a chain 25 are fastened to the frame 24 for adjusting the height of the frame 24. The chain 25 is conducted over an upper deflection roll 26 and a lower drive roll 27. The drive roll 22 for the delivery conveyor 15 is connected with a drive unit 29 by a chain 28. In the embodiment of FIG. 1, the rotary speed of the drive unit 29 is continuously variable in a controlled and yet to be described manner. The drive roll 27 is coupled to a reversible drive unit 31 by a chain 30. The control of the drive unit 31 is yet to be described.

Both drive units 29 and 31 are mounted on a platform 32 which projects laterally from the lower end of a pivotably journaled vertical column 33 and is fastened to this vertical column 33. The vertical column 33 is rotatably or pivotably journaled at the locations designated by the reference numerals 34, 35 and 36. A cantilever arm 37 is fastened to the upper end of the pivotably journaled vertical column 33. The not particularly shown vertical guide rails for the frame 24 extend between this cantilever arm 37 and the platform 32.

A counterbelt or contact belt 38 is also mounted in the cantilever arm 37 and primarily serves to press the newspapers 11 against the vertical portion of the conveying run of the delivery conveyor 15 extending between the deflection rail 7 and the deflection roll 18. Since this section of the conveying run is of variable length, the counterbelt or contact belt 38 runs over a suitable length compensation apparatus to be described shortly.

As can be seen in FIGS. 1 and 1A, the counterbelt or contact belt 38 extends around the deflection roll 18 conjointly vertically translatable with the frame 24, then around a roll 39 rotatably journaled in fixed location in the cantilever arm 37, thence around a first deflection roll 40, around a second deflection roll 41, around a third deflection roll 42 and finally around a larger fourth deflection roll 43 arranged above the initial region of the conveying run of the delivery conveyor 15. While the rolls 39, 41 and 43 are rotatably journaled in fixed position in the cantilever arm 37, the rolls 40 and 42 are rotatably journaled in a roll support frame 45 horizontally translatable in the cantilever arm 37 against the action of a gas spring 44. The roll support frame 45 can be translated into the position shown in dotted lines in FIGS. 1 and 1A and thereby makes available as much length of counterbelt or contact belt 38 as is required for following the downward motion of the frame 24, while the gas spring 44 effects a reduction of the active length of the counterbelt or contact belt 38 as the frame 24 moves upwardly.

A rotary driven stack support 46 in the form of a turntable is situated beneath the outlet or conveyor discharge station 20 of the delivery conveyor 15. The stack support 46 is provided with support rollers 47 on its underside arranged in substantially uniform circumferential spacing and with laterally effective guide rollers 48 which are supported against a guide rail 49 having an L-shaped cross section describing a circular track, i.e. the guide rollers 48 are guided by the guide rail 49. So much for the construction substantially common to the embodiments of FIGS. 1 and 1A.

In the embodiment of FIG. 1 a chain sprocket 50 is mounted in the center of the underside of the stack support 46. The chain sprocket 50 is coupled to a stationarily arranged drive unit 52 by a chain 51. The rotary speed of the drive unit 52 is, as is yet to be described, continuously variable in controlled manner and sets the stack support 46 into rotation about an upright axis of rotation 54 in the direction of the arrow 53.

According to FIGS. 1 and 1A, the upper side of the stack support 46 is substantially planar and serves to accommodate the stack 55 shown in FIGS. 1 and 1A in the full height of its periphery. This stack 55 is formed from the newspapers 11 delivered by the delivery conveyor 15. As previously mentioned, the platform 32 with the drive units 29 and 31 and the cantilever arm 37 together with the delivery conveyor 15 and the counterbelt or contact belt 38 as well as the frame 24 with the column 33 are both rotatable or pivotable.

A gear 56 is seated on the column 33 in the region of its lower end for this purpose. The gear 56 meshes with a drive pinion 57 of an angle gear drive 58. A reversible motor 59, for instance an indexing motor or a stepping motor, is flanged to the angle gear drive 58. The gear reduction drive ratio between the pinion 57 and the gear 56 is chosen such that the pinion 57 performs less than a single revolution for pivoting the column 33 in one direction and the other through a predetermined angle of rotation limited by a predetermined pivoting angle of the delivery conveyor 15 (cf. FIG. 2). Therefore, the momentary angular orientation of the column 33 can be unambiguously determined from the current angular position of the pinion 57. The pinion 57 is therefore fixedly connected to a sector plate 60 whose position is sensed by a stationarily arranged electrical signal transducer 61, for instance a potentiometer.

An only schematically indicated swing arm 63 carrying a freely rotatable wheel 62 at its end is pivoted to the frame 24. The swing arm 63 appropriately senses the momentary height of the stack 55, for instance in relation to the frame 24. The swing arm 63 operates an electrical height transducer 64 which, in turn, activates in one direction or the other or deactivates the drive unit 31 for adjusting the height of the frame 24 through a conductor or line 65 and a reversing switch 66. A speed transducer 67, for instance a tachogenerator, is arranged at the end of the individual conveyor 12 for sensing the conveying speed of this individual conveyor 12.

The rotary speed of the stack support 46 is preferably adapted to the conveying speed of the individual conveyor 12. The signal of the speed transducer 67 therefore is transmitted through a conductor 68 in FIG. 1 to a guide control circuit or regulator device 69 which, in turn, controls the drive unit 52 and determines its rotary speed through a control conductor or line 70. When the conveying speed of the individual conveyor 12 is constant in FIG. 1 the rotary speed of the stack support 46 is also constant.

In contrast, the circumferential speed of the stack support 46 in the vicinity of its circumference is considerably greater than in the vicinity of its axis of rotation 54. This means that the imbricated formation deposited by the conveyor discharge station 20 in the region of the periphery of the stack support 46 is extended or fanned out in the sense that the spacing or pitch between successive two-dimensional flat structures or entities (imbrication distance) is increased. In contrast, the imbricated formation is condensed in the region of the axis of rotation 54, i.e. the imbrication distance is reduced.

In order not to leave this variation of the imbrication distance determined by the momentary distance of the conveyor discharge station 20 from the axis of rotation 54 entirely to chance, the drive unit 29 for the delivery conveyor 15 is coupled to a second guide control circuit or regulator device 72 in FIG. 1 by a control conductor or line 71. The second regulator device 72 determines the rotary speed of the drive unit 29. The signal of the position sensor 61 is transmitted through a conductor 73 to the input of the guide control circuit or regulator device 72 as a reference value or guide value, while the signal of the speed sensor 67 is conducted through a conductor or line 74 to a further input of the circuit or regulator device 72 as a reference value or influence value. The rotary speed of the drive unit 29 is thus dependent both upon the momentary distance of the conveyor discharge station 20 from the upright axis of rotation 54 and upon the delivery speed of the individual conveyor 12. The rotary speed of the drive unit 29 is adjusted in controlled manner to the imbrication distance in the desired manner during the conveying operation upon the delivery conveyor 15 before the imbricated formation is deposited upon the stack 55 through the conveyor discharge station 20.

It was previously mentioned that the closer the conveyor discharge station 20 is to the upright axis of rotation 54, the less the imbrication distance is. The thickness of the deposited imbricated formation is also correspondingly greater. An inverse relation pertains at greater distances of the conveyor discharge station 20 from the upright axis of rotation. This would have the result that the upper side of the stack 55 being formed would very soon become conical or frustro-conical. In order to prevent this, the following measures are taken in the embodiment described in FIG. 1. The reversible motor 59 which oscillatingly pivots the delivery conveyor 15 about the column 33 is controlled by a special programmed guide control circuit or regulator device 75 through a conductor or line 76 in respect of rotary speed and rotary direction or—in the case of a stepping motor—in respect of stepping sequence and stepping direction. The signal of the position sensor 61 is conducted to this guide control circuit or regulator device 75 through a conductor or line 77 as a reference value or guide value and the signal of the speed sensor 67 is conducted to this guide control circuit or regulator device 75 through a conductor or line 78 as a reference value or influence value.

The guide control circuit or regulator device 75 is programmed (for instance by means of a separate programming unit 80) such that the motor 59 rotates more slowly or performs slower stepping sequences in both directions of rotation the further the conveyor discharge station 20 is from the upright axis of rotation 54 and vice versa. This has the result that, as indicated by the spiraling dotted line 79 in FIG. 2, the individual spiral windings within a layer laterally overlap to a greater degree the further the conveyor discharge station 20 is from the upright axis of rotation 54 and to a lesser degree the nearer the conveyor discharge station 20 is to the upright axis of rotation 54. It is thus more or less ensured that the upper surface of the stack 55 being formed remains essentially planar.

In the embodiment of FIG. 1A, a friction wheel 150 rotatably journaled on the free end of a cantilever arm 151 anchored on the platform 32 engages the underside of the stack support 46. The friction wheel 150 is in positively engaging drive engagement with the drive roll 22 through two chains 152. The circumferential speed of the friction wheel 150 is thus always strictly proportional—or with the appropriate gear reduction ratios even equal—to the transport or conveying speed of the delivery conveyor 15.

This produces the result that the friction wheel 150 drives the stack support 46, and the stack 55 forming thereupon, in the sense of the arrow 53 about the substantially vertical or upright axis of rotation 54. As will yet be seen, the rotary speed with which the stack support 46 is driven depends on the momentary position of the conveyor discharge station 20 and therefore of the friction wheel 150 in relation to the upright axis of rotation 54.

The speed sensor 67 provided at the end of the individual conveyor 12, for instance a tachogenerator, which senses the conveying speed of the individual conveyor 12, controls the rotary speed of the motor 29 or adapts the rotary speed of the motor 29 to the conveying speed of the individual conveyor 12 through means not particularly shown in FIG. 1A.

Since the friction wheel 150 periodically and in synchronism with the conveyor discharge station 20 approaches and retreats from the upright axis of rotation 54 of the stack support 46, the rotary speed of the stack support 46 in FIG. IA is variable. This rotary speed is higher the smaller the distance of the friction wheel 150 from the upright axis of rotation 54 is and vice versa. In any event, the momentary circulating speed of the stack support 46 or of the stack 55 is adapted to the conveying speed of the delivery conveyor 15 at the location situated immediately beneath the conveyor discharge station 20 of the delivery conveyor 15. It is thus achieved that the distance between successive newspapers 11 in FIG. 1A, the so-called "imbrication distance ", remains constant in the stack 55 independently of whether the imbricated formation is deposited upon the stack 55 in the region of the circumference of the stack support 46 or in the vicinity of its axis of rotation.

If desired or necessary, the motor 59 can be controlled by a programming device not particularly shown in FIG. 1A which ensures that for each revolution of the stack support 46 the column 33 is pivoted through such an angle that a circular arc whose length is approximately the same as or somewhat smaller than the format dimension of the delivered newspapers 11 measured transverse to the conveying direction of the delivery conveyor 15 at the height of the conveyor discharge station 20 corresponds thereto.

In the embodiment of FIG. IA the control circuits or regulator devices 69, 72 and 75 of FIG. 1 therefore are omitted.

Figure 2:
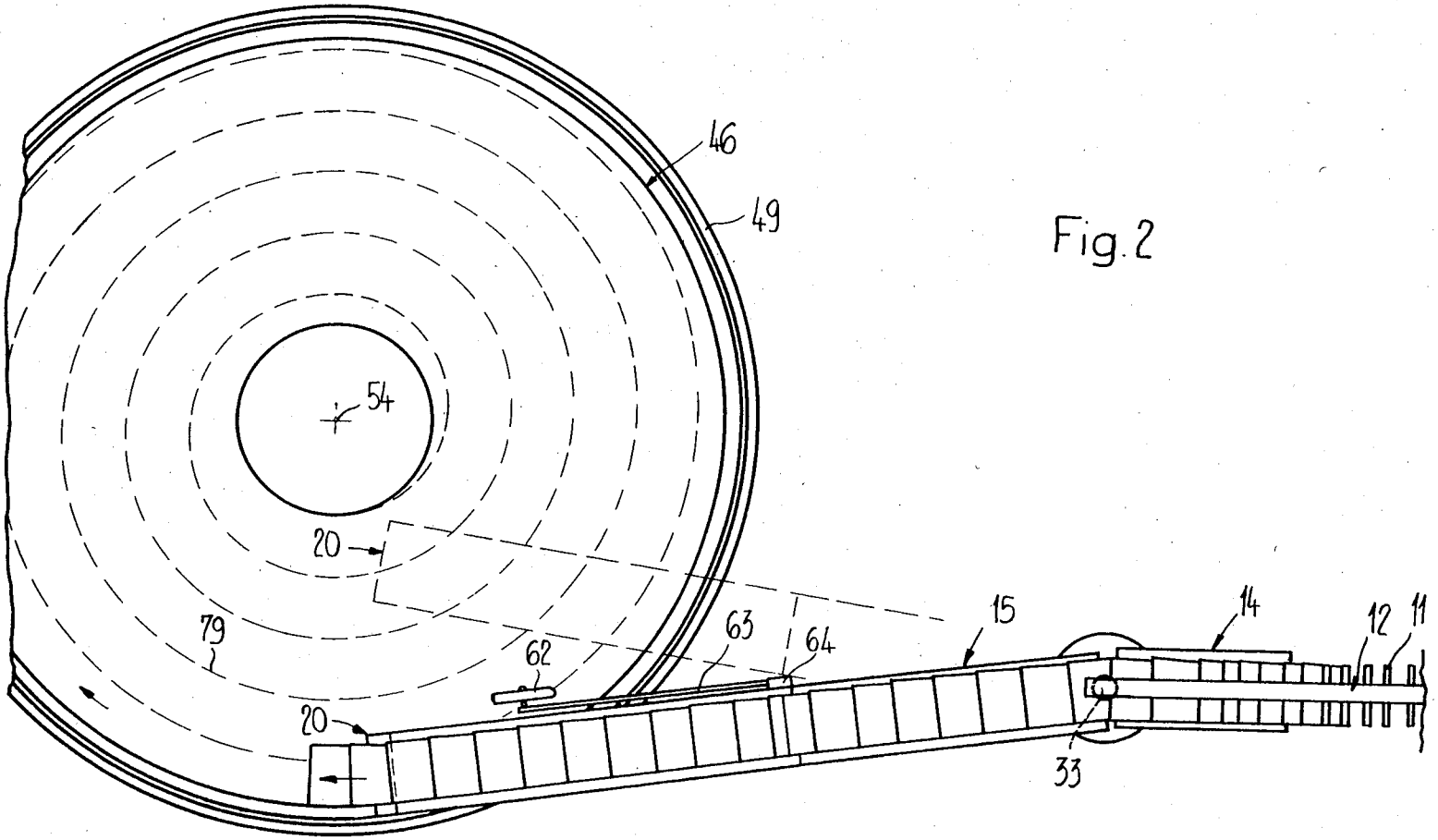
FIG. 2 schematically shows a simplified plan view of the apparatus according to FIGS. 1 and 1A in which the contour of the spiral generated in the uppermost coil layer is indicated in dotted lines.

In the schematic plan view shown in FIG. 2 of the apparatus according to FIGS. 1 and 1A, the contour or periphery of one spiral of the stack is indicated by the dotted line 79. This single spiral corresponds to a single layer or coil of the spiral-layered coiled stack 55.

In the embodiments represented in FIGS. 1 and 1A, the bound or folded edge of each newspaper 11, as seen in the circulation or revolving direction 53 of the stack 55, forms a leading edge of the newspaper which comes to lie over a trailing edge formed by the cut or fan edge of the preceding newspaper. This formation may, according to the manner in which and the means by means of which the stack 55 is to be disassembled later, not be the most favorable. In FIGS. 3 and 4 two possibilities of constructing the conveyor discharge station 20 are indicated which produce a different formation upon the stack 55 being formed. According to FIG. 3 a stop member or abutment 81 is arranged subsequent to the deflection roll 19 and in spaced relationship thereto and a short subsequent belt 82 driven in the opposite direction is present beneath the deflection roll 19 which terminates immediately above the stack 55 now circulating or revolving in the direction of the arrow 53'. Newspapers 11 leaving the deflection roll 19 impinge against this abutment 81 with their fold edge and subsequently fall upon the subsequent belt 82 running in the opposite direction. The leading edge of each newspaper 11 is the cut edge or fan edge upon this subsequent belt 82 running in the opposite direction and this cut edge or fan edge comes to lie over the folded edge of the preceding newspaper 11.

In FIG. 4, a roll or drum 84 driven in the direction of the arrow 83 follows the deflection roll 19. The roll or drum 84 forms conjointly with a continuous counterbelt or contact belt 85 partially wrapping the roll or drum 84 a conveying gap describing a circular arc of about 180° which accommodates the imbricated formation leaving the deflection roll 19 and turns the imbricated formation downwardly through 180°. The folded edge of each newspaper 11 is also in this case, as seen in the circulation or revolving direction 53' (cf. FIG. 4) of the stack 55, its leading edge which, however, does not come to lie over the trailing edge of the preceding newspaper 11 but under it.

A straight oscillating translation of the conveyor discharge station 20 of the delivery conveyor 15 can be provided instead of the pivoting motion of the delivery conveyor 15 about the column 33.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for forming a spiral-layered coiled stack from substantially two-dimensional flat structures, especially printed products, continuously arriving in imbricated formation, comprising:

a delivery conveyor for delivering the imbricated formation;

said delivery conveyor being provided with a conveyor discharge station;

a rotary driven stack support arranged beneath said conveyor discharge station and defining an upright axis of rotation;

said rotary driven stack support and at least said conveyor discharge station being adjustable in height in relation to one another; and means for periodically displacing said conveyor discharge station and said upright axis of rotation relative to one another alternatingly toward and away from one another.

2. The apparatus as defined in claim 1, further including:

means defining a pivot axis extending substantially parallel to said upright axis of rotation;

said upright axis of rotation being stationary;

said delivery conveyor having an end region;

said end region substantially terminating at said conveyor discharge station;

said end region extending in tangential relationship to circles concentric to said upright axis of rotation; and at least said end region being oscillatingly pivotable about said pivot axis.

3. The apparatus as defined in claim 2, wherein:

said conveyor discharge station and said upright axis of rotation define a spacing therebetween; and means for regulating the rotary speed of said rotary driven stack support in dependence of said spacing.

4. The apparatus as defined in claim 2, further including:

a reversible motor;

a pivotably journaled column defining said pivot axis;

said pivotably journaled column having an upper end;

said upper end supporting said delivery conveyor;

said pivotably journaled column being coupled to said reversible motor; and said reversible motor being constructed to impart a periodically oscillating pivoting motion within predeterminate angular limits to said pivotably journaled column.

5. The apparatus as defined in claim 4, further including:

first drive means for said delivery conveyor;

second drive means for adjusting said conveyor discharge station in height; and said first drive means and said second drive means being arranged to pivot conjointly with said pivotably journaled column.

6. The apparatus as defined in claim 5, further including:

a platform mounted to said pivotably journaled column; and said platform supporting said first drive means and said second drive means.

7. The apparatus as defined in claim 4, further including:

a positively engaging gear drive unit;

said reversible motor being coupled to said pivotably journaled column through said positively engaging gear drive unit;

said positively engaging gear drive unit comprising at least one drive component;

said at least one drive component defining conjointly with a driven component of said pivotably journaled column a gear drive ratio; and said gear drive ratio being selected such that said at least one drive component requires less than a single revolution to pivot said pivotably journaled column within said predetermined angular limits.

8. The apparatus as defined in claim 4, further including:

a position sensor for sensing momentary angular orientations of said pivotably journaled column.

9. The apparatus as defined in claim 7, further including:

a position sensor for sensing momentary angular orientations of said pivotably journaled column;

stationarily arranged electrical signal transducer means;

said position sensor comprising a sector plate mounted to said at least one drive component; and said sector plate being coupled to said electrical signal transducer means.

10. The apparatus as defined in claim 9, wherein:

said electrical signal transducer means comprises a potentiometer.

11. The apparatus as defined in claim 1, further including:

an individual conveyor preceding said delivery conveyor;

said individual conveyor having a conveying speed;

a speed sensor for sensing said conveying speed;

said delivery conveyor having a drive speed;

said rotary driven stack support having a rotary speed;

a first regulator device;

a second regulator device;

said speed sensor regulating said drive speed through said first regulator device; and said speed sensor regulating said rotary speed through said second regulator device.

12. The apparatus as defined in claim 11, wherein:

said speed sensor comprises a tachogenerator.

13. The apparatus as defined in claim 8, further including:

an individual conveyor preceding said delivery conveyor;

said individual conveyor having a conveying speed;

a speed sensor for sensing said conveying speed;

said delivery conveyor having a drive speed;

said rotary driven stack support having a rotary speed;

a first regulator device;

a second regulator device;

said speed sensor regulating said drive speed through said first regulator device;

said speed sensor regulating said rotary speed through said second regulator device;

said conveyor discharge station and said upright axis of rotation defining a spacing therebetween; and said first regulator device being additionally coupled to said position sensor for additionally regulating said drive speed in dependence of said spacing.

14. The apparatus as defined in claim 4, further including:

a position sensor for sensing momentary angular orientations of said pivotably journaled column;

an individual conveyor preceding said delivery conveyor;

said individual conveyor having a conveying speed;

a speed sensor for sensing said conveying speed;

said delivery conveyor having a drive speed;

said rotary driven stack support having a rotary speed;

a first regulator device;

a second regulator device;

a third regulator device;

said speed sensor regulating said drive speed through said first regulator device;

said speed sensor regulating said rotary speed through said second regulator device;

said third regulator device controlling said reversible motor; and said third regulator device being coupled to said position sensor and to said speed sensor.

15. The apparatus as defined in claim 14, further including:

a program device for determining stepping sequences and stepping frequencies for stepping motors;

said reversible motor comprising a stepping motor;

said third regulator device being additionally coupled to said program device.

16. The apparatus as defined in claim 1, wherein:

said conveyor discharge station is provided with an apparatus for downwardly deflecting the continuously arriving imbricated formation through an angle of substantially 180° .

17. The apparatus as defined in claim 7, further including:

rotary drive means for rotatably driving said rotary driven stack support;

said rotary driven stack support having an underside;

said rotary drive means comprising a friction drive element;

said friction drive element frictionally engaging said underside; and said friction drive element being translatable toward and away from said upright axis of rotation in synchronism with said end region of said delivery conveyor.

18. The apparatus as defined in claim 17, wherein:

said pivotably journaled column has a lower end;

said lower end supporting a cantilever arm; and said cantilever arm supporting said friction drive element.

19. The apparatus as defined in claim 17, further including:

positively engaging force transmission means; and said friction drive element and said delivery conveyor being drivingly interconnected by said positively engaging force transmission means.

20. The apparatus as defined in claim 4, wherein:

said pivotably journaled column has a lower end;

said lower end supporting a cantilever arm;

said rotary drive means comprising a friction drive element;

said cantilever arm supporting said friction drive element;

a platform being mounted to said pivotably journaled column;

said platform being conjointly pivotable with said pivotably journaled column;

first drive means being provided for said delivery conveyor;

said first drive means comprising a first drive motor;

said first drive motor additionally defining rotary drive means for rotatably driving said rotary driven stack support; and said first drive motor being supported upon said platform.

21. The apparatus as defined in claim 20, further including:

second drive means for adjusting said conveyor discharge station in height;

said second drive means comprising a second drive motor;

said second drive motor being arranged upon said platform; and said second drive motor being activatable and deactivatable in dependence of a height of the spiral-layered coiled stack in relation to said conveyor discharge station.

22. The apparatus as defined in claim 18, further including:

a reversible motor;

a positively engaging gear drive unit;

said reversible motor being coupled to said pivotably journaled column through said positively engaging gear drive unit;

said positively engaging gear drive unit comprising at least one drive component;

said at least one drive component defining conjointly with a driven component of said pivotably journaled column a gear drive ratio; and said gear drive ratio being selected such that said at least one drive component requires less than a single revolution to pivot said pivotably journaled column within said predeterminate angular limits.

23. The apparatus as defined in claim 22, further including:

a position sensor for sensing momentary angular orientations of said pivotably journaled column.

24. The apparatus as defined in claim 22, further including:

a position sensor for sensing momentary angular orientations of said pivotably journaled column;

stationarily arranged electrical signal transducer means;

said position sensor comprising a sector plate mounted to said at least one drive component;

said sector plate cooperating with said electrical signal transducer means; and said electrical signal transducer means reversing said reversible motor.

25. The apparatus as defined in claim 24, wherein:

said electrical signal transducer means comprises at least one microswitch.

* * * * *

UNITED STATES PATENT AND TRADEMARK OFFICE

CERTIFICATE OF CORRECTION

PATENT NO. : 4,566,686

DATED : January 28, 1986

INVENTOR(S) : WALTER REIST

It is certified that error appears in the above—identified patent and that said Letters Patent is hereby corrected as shown below:

Column 2, line 49, delete "entitles" and insert --entities--

Column 2, line 56, delete "appartus" and insert --apparatus--

Column 3, line 68, after "rail", delete "7" and insert --17--

Column 6, line 63, delete "IA" and insert --1A--

Column 7, line 19, delete "IA" and insert --1A--

Signed and Sealed this

*Seventeenth* Day of *June 1986*

[SEAL]

*Attest:*

DONALD J. QUIGG

*Attesting Officer*

*Commissioner of Patents and Trademarks*